United States Patent [19]

Tomono et al.

[11] 4,107,062

[45] Aug. 15, 1978

[54] TONER FOR DEVELOPING ELECTROSTATIC LATENT IMAGES COMPRISING AN AMINE-EPOXY RESIN MIXTURE

[75] Inventors: Makoto Tomono, Hino; Goichi Yamakawa, Hachioji; Mitsunori Ohta, Kunitachi, all of Japan

[73] Assignee: Konishiroku Photo Industry Co., Ltd., Tokyo, Japan

[21] Appl. No.: 756,627

[22] Filed: Jan. 4, 1977

[30] Foreign Application Priority Data

Jan. 13, 1976 [JP] Japan ..... 51-3559

[51] Int. Cl.[2] ..... G03G 9/08

[52] U.S. Cl. ..... 252/62.1 P; 96/1 SD; 252/62.1 R; 252/62.54; 260/37 EP; 260/42.28; 528/492

[58] Field of Search ..... 252/62.1 P, 62.1 R, 252/62.54; 96/1 SD; 260/37 EP, 42.28; 528/492

[56] References Cited

U.S. PATENT DOCUMENTS

| | | | |
|---|---|---|---|
| 3,938,992 | 2/1976 | Jadwin et al. | 252/62.1 P |
| 3,954,762 | 5/1976 | Helm | 528/492 |
| 4,021,358 | 5/1977 | Tomono et al. | 252/62.1 P |

*Primary Examiner*—John D. Smith

*Attorney, Agent, or Firm*—Lane, Aitken, Dunner & Ziems

[57] ABSTRACT

According to the present invention, there is provided a toner for developing electrostatic latent images, which includes a colorant, an amine-addition resin and, if desired, the resin miscible with the amine-addition resin. The above mentioned amine-addition resin is further obtained by interacting an epoxy group-containing resin and an aliphatic primary or secondary amine.

8 Claims, No Drawings

TONER FOR DEVELOPING ELECTROSTATIC LATENT IMAGES COMPRISING AN AMINE-EPOXY RESIN MIXTURE

BACKGROUND OF THE INVENTION

This invention relates to a toner for the dry development in an electrographic art.

Broadly speaking, methods for developing electrostatic latent images can be classified into three categories: liquid development using developers obtained by dispersing various kinds of pigments and/or dyes in dielectric organic liquids; two-component dry development using developers obtained by mixing toner particles dispersing a colorant such as carbon black in natural or synthetic resins, with carrier particles such as iron powder or glass beads, i.e., a cascade method, a fur brush method, a magnetic brush method, an impression method, a powder cloud method and the like; and one-component dry development using developers obtained by mixing with fluid agents toners composed of a mixture of natural or synthetic resins used for the magnetic brush method, magnetic particles such as magnetite and pigments and/or dyes. In the sense, the present invention relates to electrophotographic developing toners of the type which is directed to the latter two-component or one-component dry development system.

Toners which are conventionally employed in the two-component development system are generally in the form of fine powder which is obtained by dispersing a charge controller and a dye or pigment serving as a colorant in a synthetic or natural resin, while the one-component development system generally uses toners in the form of fine powder which contains magnetic powder such as magnetite, a charge controller and a dye or pigment all dispersed in a synthetic or natural resin. In the two component system, these toners are practically applied, for example, by a magnetic brush method as follows: the toners are first triboelectrically charged and attached onto carrier particles such as iron powder and placed in a magnetic field to permit the particles to take a brush form. While, in the one-component system, the toners are allowed to be triboelectrically charged by the triboelectrification with and electrophotographic photosensitive medium or a developing container or by mutual triboelectrification therebetween and shaped into a brush form under the influence of a magnetic field in practical application. In order to reproduce a clear image with reduced fogging, it is essential that the toner particles be uniform in charge amount and size. Various kinds of pigments and dyes serving as a charge controller or colorant are known including, for example, carbon black (Colour Index Pigment Black 7), Nigrosine (C.I. Solvent Black 7), Aniline Blue (C.I. Acid Blue 20), Calonyl Blue (C.I. Axoic Blue 3), Chrome Yellow (C.I. Pigment Yellow 34), Ultramarine Blue (C.I. Pigment Blue 29), Du Pont Oil Red (C.I. Solvent Red 24), Quinoline Yellow (C.I. Acid Yellow 3), Methylene Blue Chloride (C.I. Basic Blue 9), Malachite Green Oxalate (C.I. Basic Green 4), lamp black (C.I. Pigment Black 6), Rose Bengal (C.I. Acid Fed 93), other aliphatic acid metal salts, metal-containing dyes and the mixtures thereof. However, these dyes and pigments are poor in miscibility with resins, so that it takes a long period of melting and mixing time to uniformly disperse the dyes and pigments in the resins. In most cases, the resulting toners are not uniform in amount of the static charge thereof. In addition, the toners suffer from mechanical impact force when agitated in a magnetic brush and will be, upon development, finer in particle size than those as expected. As a result, fogging will appear on an electrostatic image and toner filthing is liable to form an iron powder on the surface of the photosensitive medium, reducing the durability of the developer.

The known toners using resins such as polystyrene, styreneacryl copolymer, polyamide, epoxy resin and the like, produce the above-mentioned disadvantages after only several thousand cycles of copying. In order to avoid this, it will suffice to increase mechanical strengths, i.e., molecular weight, of the resin. However, the increase of the molecular weight of the resin involves a disadvantage that the fixation either by application of heat or by solvent is made difficult. In addition, the powdering in the toner producing step will become difficult.

SUMMARY OF THE INVENTION

According to the present invention, there is provided a toner which contains a resin obtained by interacting an epoxy group-containing resin and an aliphatic primary or secondary amine. The toner thus obtained is suitable for the dry development in electrophotography.

The toner of the invention is not required to contain a charge controller since the resin per se is imparted with good positive chargeability. The resin, i.e., the reaction product of an epoxy group-containing resin and an aliphatic amine, has long alkyl group side chains and is therefore improved in miscibility with dyes or pigments and durability over known toners, without impairing fixativeness.

It is therefore an object of the invention to provide a toner which is easy to produce and excellent in mechanical durability and fixativeness and which has uniform and positive chargeability.

DETAILED DESCRIPTION OF THE INVENTION

Typical of the epoxy group-containing resins to be interacted with aliphatic primary or secondary amines are those available from Shell Co., in Holland under the designation "Epikote" and including Epikote Nos. 828, 834, 830, 1001, 1002, 1004, 1007, etc., epoxy resins available from Ciba Ltd., in Switzerland under the designation "Araldite" and including Araldite Nos. 6071 and 6084, glycidyl ethers (bisphenol F) of novolak resin, glycidyl ethers of tetrachlorobisphenol A, and the like.

As toner resin, there may be also used reaction products obtained by interacting an epoxy group-containing copolymer or homopolymer such as of glycidyl methacrylate and an aliphatic primary or secondary amine. Monomers useful for the preparation of the copolymers with glycidyl methacrylates include, for example, p-chlorostyrene, vinylnaphthalene, ethylenically unsaturated monoolefins such as ethylene, propylene, butylene, isobutylene, vinyl esters such as vinyl chloride, vinyl bromide, vinyl fluoride, vinyl acetate, vinyl propionate, vinyl benzoate, vinyl butyrate, etc., $\alpha$-methylene aliphatic monocarboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, methyl $\alpha$-chloroacrylate, methyl methacrylate, ethyl methacrylate, butyl methacrylate, etc., acrylonitrile, methacrylonitrile, acrylamide, vinyl ethers such as vinyl methyl ether, vinyl ethyl ether, vinyl isobutyl ether, etc., vinyl ketones such as vinyl methyl ketone, vinyl hexyl ketone, vinyl isopropenyl ketone, etc., N-vinyl compounds such as N-vinyl pyrrole, N-vinyl carbazole, N-vinyl indole, N-vinyl pyrrolidone, etc. These monomers may be used singly or in combination for copolymerization with glycidyl methacrylate.

Examples of aliphatic primary monoamines are hexylamine, isohexylamine, heptylamine, octylamine, nonylamine, decylamine, undecylamine, laurylamine, tridecylamine, tetradecylamine, pentadecylamine, hexadecylamine, heptadecylamine, stearyamine, etc., while examples of the aliphatic secondary amines are symmetrical secondary amines and mixed secondary amines including, for example, methylethylamine, methylbutylamine, methylacrylamine, methylpropylamine, ethylpropylamine, ethylbutylamine, ethylhexadecylamine, propylbutylamine, butylisobutylamine, etc. The above-indicated primary and secondary monoamine compounds should preferably have an amine residue containing 8 or more carbon atoms. Further, usable diamines include ethylenediamine, trimethylenediamine, pentamethylenediamine, hexamethylenediamine, heptamethylenediamine, octamethylenediamine, nonamethylenediamine, decamethylenediamine, undecamethylenediamine, dodecamethylenediamine, etc.

Upon preparing the resin, the epoxy group-containing resin and the amine are mixed and reduced to powder, and reacted with each other for several hours under thermally molten conditions. Alternatively the resin and the amine may be dissolved in solvent and reacted under agitating and heating conditions, followed by distilling off the solvent to obtain a reaction product. Upon the reaction in solvent, it is preferred to use a solvent compounds having OH group, COOH group, $SO_3H$ group since such solvent also serves as catalyst for accelerating the reaction.

Through the thus obtained amine-addition epoxy resin may be used singly as toner resin, it is preferred to employ in combination with other resin miscible therewith in order to improve a softening temperature and mechanical strengths. In the latter case, the amount of the amine-addition epoxy resin is required to be 10% or more, preferably above 20%, of the total resin. The resins suitable for mixing with the amine-addition epoxy resin include polystyrene, styrene-acryl copolymers, epoxy resins, and, homopolymers or copolymers of vinyl naphthalene, vinyl esters such as vinyl chloride, vinyl bromide, vinyl fluoride, vinyl acetate, vinyl propionate, vinyl benzoate, vinyl butyrate, etc., $\alpha$-methylene aliphatic monocarboxylic acid esters such as methyl acrylate, ethyl acrylate, n-butyl acrylate, isobutyl acrylate, dodecyl acrylate, n-octyl acrylate, 3-chloroethyl acrylate, phenyl acrylate, methyl $\alpha$-chloroacrylate, methyl methacrylate, ethyl methacrylate, butyl methacrylate, etc., acrylonitrile, methacrylonitrile, acrylamide, vinyl ethers such as vinyl methyl ether, vinyl isobutyl ether, vinyl ethyl ether, etc., vinyl ketones such as vinyl methyl ketone, vinyl hexyl ketone, methyl isopropynyl ketone, etc., and N-vinyl compounds such as N-vinylpyrrole, N-vinylcarbazole, N-vinylindole, N-vinylpyrrolidone, etc., and non-vinyl thermoplastic resins such as rosin-modified phenol-formaldehyde resin, cellulose resin, polyester resin, etc. Of these, the most preferable fesin to mix with the amine-addition epoxy resin is one used for the reaction with the amines, i.e., epoxy resin, due to its excellency in miscibility with the amine-addition epoxy resin.

In order to prepare the toner of the two-component type according to the invention 10 - 100 parts by weight, preferably 20 - 100 parts by weight, of the resin obtained by reaction of an epoxy group-containing resin and a primary or secondary amine in equivalent ratio is first mixed with correspondingly with 90 - 0 parts by weight, preferably 80 - 0 parts by weight, of the resin miscible with the above-mentioned resin. The mixture is roughly divided and kneaded at a temperature of 100° - 150° C by means of a kneader, to which is further added 1 - 10 parts by weight of a colorant such as dye or pigment while kneading. Then, the mixture is cooled to solidify, coarsely and then finely powdered, and classified to obtain toner particles with an average size of 5 - 20 $\mu$. With the toner of the one-component type, 100 parts by weight of the amine-addition epoxy resin according to the invention with or without being mixed with a resin miscible therewith is added with 60 - 250 parts by weight of magnetic powder such as of magnetite and 1 - 10 parts by weight of a colorant such as dye or pigment, followed by mixing, kneading, cooling, powdering and classifying to obtain the intended toner.

The present invention will be particularly illustrated by way of the following examples, which should not be construed as limitation thereof.

EXAMPLE 1

| | |
|---|---|
| Epikote 1001 | 100 parts by weight |
| stearylamine | 26 parts by weight |

The components of the above formulation were mixed and reduced to powder and reacted in a reaction vessel at 120° - 160° C for 1 - 2 hours to obtain a resin.

| | |
|---|---|
| obtained resin | 40 parts by weight |
| Epikote 1004 | 60 parts by weight |
| carbon black | 5 parts by weight |

The mixture of the above formulation was comminuted and kneaded by means of a pair of heat rollers of 100° - 110° C. After cooling, the kneaded mixture was coarsely divided by a hammer mill, finely powdered in a jet mill, and classified to obtain toner particles in a size range of 5 - 25 $\mu$.

The thus obtained toner was mixed with iron powder carrier in an amount of 4% by weight of the carrier to give a developer. The developer was then subjected to a duplication test using a solid black original, a half-tone photograph and a letter-containing original by means of a commercially available duplicator of a zinc oxide type. As a result, it was found that there were obtained fogging-free, clear, positive images which were faithful to the originals and excellent in dissolving power. The image obtained even after the cycles of about 13,000 copies was similar in image quality to the initially obtained copies and had still good fixativeness.

EXAMPLE 2

| | |
|---|---|
| Araldite 6071 | 100 parts by weight |
| laurylamine | 20 parts by weight |

These components were reacted in the same manner as in Example 1 to obtain a resin.

| | |
|---|---|
| obtained resin | 80 parts by weight |
| Epikote 1004 | 20 parts by weight |
| carbon black | 5 parts by weight |

The composition of the above formulation was treated in the same procedure as in Example 1 to obtain a toner. The thus obtained toner was used for the copying test in the same manner as in Example 1, with the result that the positive images reproduced were found to be clear, excellent in gradation and free of fogging, and could stand about 15,000 copies. Also it was found that the toner was excellent in fixativeness.

EXAMPLE 3

| | |
|---|---|
| Epikote 1001 | 100 parts by weight |
| stearylamine | 26 parts by weight |

These components were reacted similarly to Example 1 to obtain a resin.

| | |
|---|---|
| obtained resin | 50 parts by weight |
| styrene-butyl methacrylate copolymer in a mole ratio 65:35 | 50 parts by weight |
| carbon black | 5 parts by weight |

Then, the procedure of Example 1 was repeated using the toner of the above formulation, revealing that clear, fogging-free, good positive image were obtained during the copying cycles of about 20,000 copies.

EXAMPLE 4

| | |
|---|---|
| Epikote 1001 | 100 parts by weight |
| 1,12-dodecanediamine | 10 parts by weight |
| toluene | 1000 parts by weight |
| tetrahydrofuran | 200 parts by weight |
| n-butanol | 1000 parts by weight |

The composition of the above formulation was heated in a heat bath of 100° C for 1 - 2 hours while agitating, and the mixed solvent was removed by distillation at 100° C over 4 - 5 hours to obtain a resin.

| | |
|---|---|
| obtained resin | 20 parts by weight |
| Piccolastic D-125 (polystyrene) | 80 parts by weight |
| carbon black | 5 parts by weight |

Example 1 was repeated using the composition of the above formulation to obtain a toner. The thus obtained toner was used for the copying test in the same manner as in Example 1. As a result, it was found that reproduced images were excellent in solving power, free of fogging and excellent in quality during the cycles of 23,000 copies. Also it was found that the toner had good fixativeness.

EXAMPLE 5

| | |
|---|---|
| styrene-glycidyl methacrylate copolymer in a mole ratio 84:16 | 100 parts by weight |
| methylethylamine | 9 parts by weight |
| toluene | 1000 parts by weight |
| tetrahydrofuran | 200 parts by weight |
| n-butanol | 1000 parts by weight |

The composition of the above formulation was treated in the same manner as in Example 4 to obtain a resin.

| | |
|---|---|
| obtained resin | 30 parts by weight |
| styrene-acryl copolymer in mole ratio 65:35 | 70 parts by weight |
| carbon black | 5 parts by weight |

Example 1 was repeated using the composition of the above formulation to give a toner. The toner was used for the copying test of Example 1, with the result that fogging-free, clear, positive images were reproduced during the cycles of 18,000 copies being taken.

EXAMPLE 6

| | |
|---|---|
| Epikote 1001 | 100 parts by weight |
| stearylamine | 26 parts by weight |

The composition of the above formulation was treated in the same manner as in Example 4 to obtain a resin.

| | |
|---|---|
| obtained resin | 20 parts by weight |
| Epikote 1007 | 80 parts by weight |
| Resino Yellow NS 70 (product of Konishi Pigment Co.) | 5 parts by weight |

Example 1 was repeated using the composition of the above formulation to obtain a yellow toner. The thus obtained yellow toner was used for the copying test in the same manner as in Example 1. As a result, it was found that fogging-free, clear, positive images were obtained during the cycles if about 20,000 copies being taken. It was found that the toner was excellent in fixativeness and suitable as color toner.

The charging amount of the toner was determined by a blow-off method and found to be $+2.5 \times 10^{-8}$ coulomb/mg.

EXAMPLE 7

| | |
|---|---|
| resin used in Example 3 | 100 parts by weight |
| Oil Pink 312 (product of Orient Chem. Co.) | 5 parts by weight |

The composition of the above formulation was treated in the same manner as in Example 1 to prepare a magenta toner. Example 1 was repeated using the magenta toner, revealing that fogging-free, clear, positive images were reproduced during the course of about 20,000 copies being takken and the toner was excellent in fixativeness. The charging amount was found to be $+2.4 \times 10^{-8}$ coulomb/mg.

EXAMPLE 8

| | |
|---|---|
| Epikote 1001 | 100 parts by weight |
| stearylamine | 26 parts by weight |

The composition of the above formulation was treated in the same manner as in Example 1 to obtain a resin.

| | |
|---|---|
| obtained resin rosin-modified phenol-formaldehyde | 20 parts by weight |

-continued

| | |
|---|---|
| resin | 80 parts by weight |
| Spilon Blue 2BNH (product of Hodogaya Chem. Co.) | 5 parts by weight |

A cyan toner was prepared by the use of the composition of the above formulation. Example 1 was repeated using the toner for copying test, with the result that positive images which were free of fogging and excellent in gradation were obtained during the cycles of 15,000 copies being taken. The toner was found to be excellent in fixativeness and suitable as color toner resin. The charging amount of the toner was $+1.5 \times 10^{-8}$ coulomb/mg.

The following Comparative Examples using the dye used in Example 8 and "Epikote" resin were to illustrate the degree of the triboelectric charge-controlling ability of the resin according to the invention.

COMPARATIVE EXAMPLE 1

| | |
|---|---|
| Epikote 1004 | 100 parts by weight |
| Spilon Blue 2BNH (product of Hodogaya Chem. Co.) | 5 parts by weight |

The composition of the above formulation was kneaded by a pair of heat rollers and finely powdered to obtain toner particles. The charging amount of the toner particles was about $-5 \times 10^{-10}$ coulomb/mg, i.e., the toner was negatively charged.

As will be clear from the above, the dye, Spilon Blue 2BNH, serves to make the toner negative. However, it is demonstrated in Example 8 that when the dye is used as a colorant in combination with the resin of the invention, the toner obtained is positively charged, which is practically important.

COMPARATIVE EXAMPLE 2

The following toner was prepared to determine durability for comparison with the black toners of Examples 1 - 5 using carbon black.

| | |
|---|---|
| Epikote 1004 | 100 parts by weight |
| carbon black | 5 parts by weight |
| Nigrosine dye | 5 parts by weight |

The composition of the above formulation was treated in the same manner as in Example 1 to obtain a toner. The toner was used to prepare a developer and then Example 1 was repeated for copying test. As a result, it was found that after cycles of 5000 copies, fogging and non-uniformity in density appeared to a material extent, making it impossible to continue the copying operation. From this, it was found that the toner containing the resin of the invention was smaller in fatique deterioration and usable over a longer period of time than known toners using Epikote resin alone when used for repeatedly forming transfer image on a zinc oxide photosensitive medium.

EXAMPLE 9

25 parts by weight of the resin of the present invention used in Example 8 was mixed with 15 parts by weight of Epikote 1004, 5 parts by weight of polyvinyl butyral resin and 50 parts by weight of magnetite and powdered in a Hencil mixer, followed by kneading by a pair of heat rollers at about 95° C for 30 min. After cooling, the kneaded mixture was coarsely reduced to pieces, thermally treated by means of an experimental spray dryer produced by Futakuchi Co., and classified to obtain magnetite toner particles of an average size of 5 - 20 $\mu$.

The thus obtained toner was subjected to a copying test by use of transfer type duplicator using a zinc oxide photosensitive medium. As a result, it was found that the toner was excellent in transferability and durability in comparison with known one-component toners.

What is claimed is:

1. A toner for use in the dry development of electrostatic images comprising:

a colorant; and a resin mixture of (A) at least 20% by weight of an amine-epoxy resin obtained by reacting an epoxy resin and an aliphatic primary or secondary monoamine having at least 8 carbon atoms and (B) a definite amount up to 80% by weight of an epoxy resin which is not reacted with an amine.

2. The toner of claim 1 in which component (B) is 20–80% by weight of said resin mixture.

3. A toner according to claim 1, wherein said epoxy resins of (A) and (B) are selected from the group consisting of glycidyl ether of a novolak resin, gylcidyl ether of tetrachlorobisphenol A, a glycidyl methacrylate homopolymer and a glycidyl methacrylate copolymer.

4. A toner according to claim 3, wherein said epoxy resins of a (A) and (B) are a glycidyl methacrylate copolymer obtained by polymerizing glycidyl methacrylate with at least one of the monomers selected from the group consisting of p-chlorostyrene, vinyl naphthalene, ethylene, propylene, isobutylene, vinyl chloride, vinyl bromide, vinyl fluoride, vinyl acetate, vinyl propionate, vinyl benzoate, vinyl butyrate, methyl acrylate, ethyl acrylate, n-butyl acrylate, isobutyl acrylate, dodecyl acrylate, n-octyl acrylate, 2-chloroethyl acrylate, phenyl acrylate, methyl $\alpha$-chloroacrylate, methyl methacrylate, ethyl methacrylate, butyl methacrylate, acrylonitrile, methacrylonitrile, acrylamide, vinyl methyl ether, vinyl ethyl ether, vinyl isobutyl ether, vinyl methyl ketone, vinyl hexyl ketone, vinyl isopropenyl ketone, n-vinyl pyrrolidone.

5. A toner according to claim 1, further comprising a magnetic powder.

6. A toner according to claim 5, wherein said magnetic powder is magnetite.

7. A toner according to claim 5, wherein said magnetic powder is contained in an amount of from 60 to 250 parts by weight per 100 parts by weight of said amine-addition resin.

8. A toner according to claim 1, wherein said reaction of said epoxy group-containing resin and said aliphatic amine is carried out in the presence of the solvent compound having at least one functional group selected from the group consisting of OH group, COOH group, $SO_3H$ group and $CONH_2$ group.

* * * * *

UNITED STATES PATENT AND TRADEMARK OFFICE

CERTIFICATE OF CORRECTION

PATENT NO. : 4,107,062

DATED : August 15, 1978

INVENTOR(S) : MAKOTO TOMONO ET AL

It is certified that error appears in the above-identified patent and that said Letters Patent are hereby corrected as shown below:

Column 1, Line 8, "electrographic" should read --- electrophotographic ---;

Column 1, Line 44, "and" should read --- an ---;

Column 3, Line 36, between "group" and "since" insert --- or $CONH_2$ group ---;

Column 3, Line 38, "Through" should read --- Though ---;

Column 6, Line 36, between "was" and "found" insert --- also ---;

Column 6, Line 54, "takken" should read --- taken ---.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*